US008832985B2

(12) United States Patent
Smith, III

(10) Patent No.: US 8,832,985 B2
(45) Date of Patent: Sep. 16, 2014

(54) ATTACHMENT ASSEMBLY FOR FIREARM SLING

(71) Applicant: 1 Pin, LLC, Savannah, GA (US)
(72) Inventor: Kayton Smith, III, Savannah, GA (US)
(73) Assignee: 1 Pin, LLC, Savannah, GA (US)

( * ) Notice: Subject to any disclaimer, the term of this patent is extended or adjusted under 35 U.S.C. 154(b) by 0 days.

(21) Appl. No.: 13/889,880

(22) Filed: May 8, 2013

(65) Prior Publication Data

US 2013/0305581 A1 Nov. 21, 2013

Related U.S. Application Data

(60) Provisional application No. 61/688,493, filed on May 16, 2012.

(51) Int. Cl.
*F41C 23/00* (2006.01)
*F41C 33/00* (2006.01)
*F41C 23/02* (2006.01)

(52) U.S. Cl.
CPC ..... *F41C 33/006* (2013.01); *F41C 23/02* (2013.01)
USPC ..... 42/85; 42/94; 224/149; 224/150

(58) Field of Classification Search
CPC ..... F41C 33/002; F41C 23/02; F41C 33/001; F41C 33/00; F41C 33/003; F41C 33/007; F41C 23/16; F41C 23/22; F41C 33/005; Y10S 224/913; A41D 13/0151
USPC ..... 42/85, 94; 224/149, 150
See application file for complete search history.

(56) References Cited

U.S. PATENT DOCUMENTS

| | | | | | |
|---|---|---|---|---|---|
| 2,942,640 | A | * | 6/1960 | Lundeberg | 411/302 |
| 3,061,965 | A | * | 11/1962 | Lewis | 42/85 |
| 3,934,768 | A | * | 1/1976 | Jones | 224/674 |
| 4,062,289 | A | * | 12/1977 | McNair | 102/371 |
| 4,209,157 | A | * | 6/1980 | Edmisten | 248/691 |
| 5,074,069 | A | * | 12/1991 | Shire | 42/85 |
| 5,303,859 | A | * | 4/1994 | Jenkin | 224/149 |
| 5,305,540 | A | * | 4/1994 | Blenk | 42/85 |
| 5,433,360 | A | * | 7/1995 | Rock | 224/258 |
| 5,692,654 | A | * | 12/1997 | Bell | 224/150 |
| 6,012,246 | A | * | 1/2000 | Robinson et al. | 42/71.01 |

* cited by examiner

*Primary Examiner* — Samir Abdosh
(74) *Attorney, Agent, or Firm* — Roylance, Abrams, Berdo & Goodman LLP

(57) ABSTRACT

An attachment assembly for securing a sling to a firearm includes a fastener having first and second ends. The fastener is receivable by a hole in the firearm such that the first and second ends are accessible on opposite sides of the firearm. A first opening in the fastener proximal the first end receives the sling. A locking member is receivable by the second end to prevent removal of the fastener from the firearm hole when connected to the firearm.

20 Claims, 14 Drawing Sheets

ATTACHMENT ASSEMBLY FOR FIREARM SLING

CROSS REFERENCE TO RELATED APPLICATION

This application claims the benefit under 35 U.S.C. §119 (e) of U.S. Provisional Application Ser. No. 61/688,493, filed May 16, 2012, which is hereby incorporated by reference in its entirety.

FIELD OF THE INVENTION

The present invention generally relates to an attachment assembly for securing a sling to a firearm. More particularly, the present invention relates to an attachment assembly including a mounting pin having an opening at a first end for receiving a sling and a locking member connectable to a second end for securing the fastener to a firearm. Still more particularly, the present invention relates to an attachment assembly that replaces an existing firearm trigger assembly retaining pin.

BACKGROUND OF THE INVENTION

Slings, such as a strap or harness, allow an individual to more easily carry a firearm, such as a shotgun. Various types of slings include a single-point sling and a two-point sling. A single-point sling has a single connection between the sling and the firearm. A two-point sling has two connections points and are typically located at opposite ends of the firearm, thereby providing the carrier with increased carrying options.

Existing sling mounts include components prone to breaking over extended periods of use. When a sling mount breaks during use, the carrier must resort to carrying the firearm with his hands, which is disadvantageous. Additionally, the carrier could be injured by a falling firearm. Accordingly, a need exists for an improved attachment assembly having sufficient strength to withstand the forces associated with carrying a firearm on a sling.

Conventional sling mounts are made for either right or left-handed shooters. Increased inventory is required to accommodate both right and left-handed shooters. Accordingly, a need exists for an attachment assembly that can be connected to a firearm for either a right or left-handed shooter.

Additionally, existing sling mounts are prone to movement when connecting a sling to a firearm. The movement of the sling mount can scratch, mar or otherwise damage the finish of the firearm, thereby diminishing the aesthetic appearance of the firearm. Accordingly, a need exists for an attachment assembly that prevents scratching, marring or otherwise damaging the finish when connecting a sling to a firearm.

Conventional sling mounts are connected to a firearm such that when carrying the firearm in a muzzle down position the muzzle of the firearm is near the ground or feet of the carrier. The firearm being located in such a position can cause the carrier to trip or stumble on the firearm, or the barrel can become snagged on brush, bushes, limbs, weeds or tall grass. Additionally, carrying the firearm in the muzzle-down position allows unwanted debris, such as water, mud or dirt, to get into the barrel, thereby obstructing the barrel. Accordingly, a need exists for an attachment assembly that raises the end of the shotgun with respect to the ground when being carried muzzle down.

Some existing sling mounts require drilling into the wood or plastic portions of the firearm, such that the sling mounts are not quickly and easily connectable to the firearm. Accordingly, a need exists for an attachment assembly that quickly and easily connects a sling to a firearm.

SUMMARY OF THE INVENTION

Accordingly, it is a primary objective of the present invention to provide an improved attachment assembly for securely connecting a sling to a firearm.

A further objective of the present invention is to provide an attachment assembly kit for securely connecting a sling to a firearm.

Another objective of the present invention is to provide an attachment assembly that connects a sling to a firearm and substantially prevents damaging the finish of the firearm.

Another objective of the present invention is a method of securing a sling to a firearm using an existing hole in the firearm.

Another objective of the present invention is to provide an attachment assembly including a fastener to which a sling is connected at a first end and a locking member is connected at a second end.

The foregoing objectives are basically attained by an attachment assembly for securing a sling to a firearm. A fastener has first and second ends and is receivable by a hole in the firearm such that the first and second ends are accessible on opposite sides of the firearm. A first opening in the fastener proximal the first end receives the sling. A locking member is receivable by the second end to prevent removal of the fastener from the shotgun hole when connected to the firearm.

The foregoing objectives are also basically attainted by providing a kit for securing a sling to a firearm. The kit includes a fastener having first and second ends receivable by the firearm for mounting the sling to the shotgun. An opening proximal the first end of the fastener receives the sling. A locking member is receivable by the fastener to prevent removal of the fastener from the firearm pin hole when connected to the firearm.

The foregoing objectives are also basically attained by a method of securing a sling to a firearm. A firearm trigger group pin is removed from a first opening in the firearm and a mounting pin is inserted therein. The mounting pin has an enlarged head member to prevent pushing the mounting pin through the first opening in a first direction. A locking member is connected to a second end of the mounting pin to prevent removal of the mounting pin from the first opening in a second direction substantially opposite to the first direction. The sling is connected to a second opening in the enlarged head member of the mounting pin.

Objects, advantages, and salient features of the invention will become apparent from the following detailed description, which, taken in conjunction with the annexed drawings, discloses exemplary embodiments of the present invention.

As used in this application, the terms "front," "rear," "upper," "lower," "upwardly," "downwardly," and other orientational descriptors are intended to facilitate the description of the attachment assembly, and are not intended to limit the structure of the attachment assembly to any particular position or orientation.

BRIEF DESCRIPTION OF THE DRAWINGS

The above aspects and features of the present invention will be more apparent from the description for an exemplary embodiment of the present invention taken with reference to the accompanying drawing figures, in which.

Throughout the drawings, like reference numerals will be understood to refer to like parts, components and structures.

DETAILED DESCRIPTION OF AN EXEMPLARY EMBODIMENT

Figure 3:
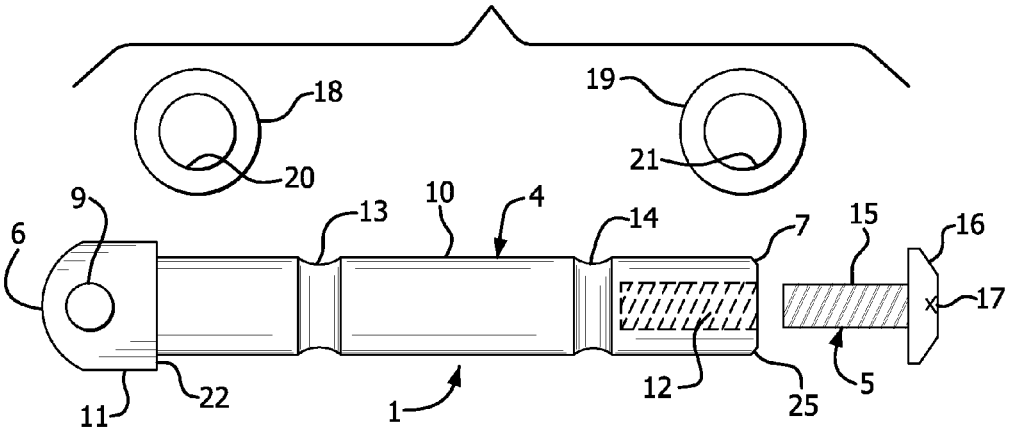
FIG. 3 is an exploded front elevational view of the attachment assembly of FIG. 2.
Figure 4:
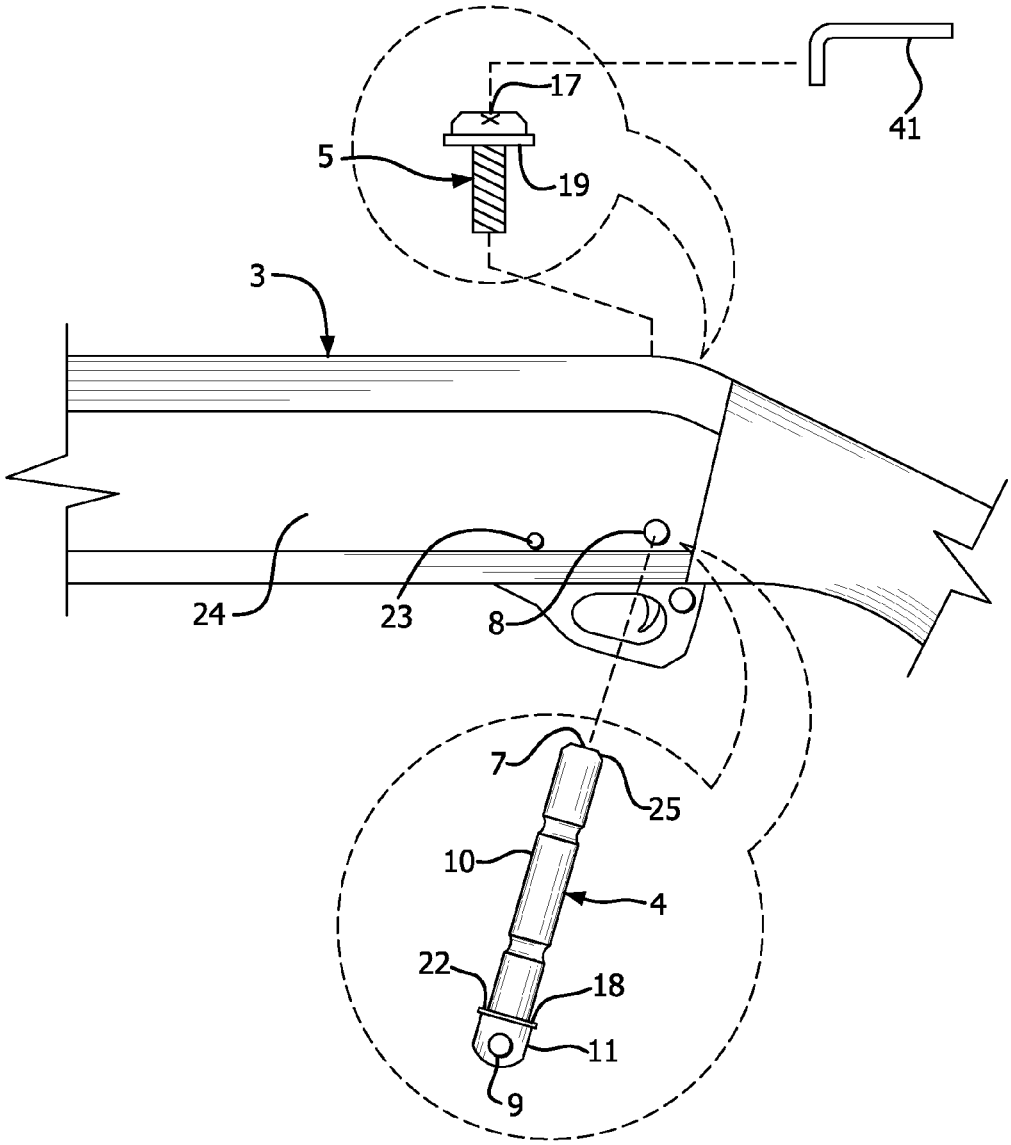
FIG. 4 is an exploded side elevational view of a shotgun with a trigger assembly retaining pin removed and prior to the attachment assembly of FIG. 2 being connected thereto.
Figure 5:
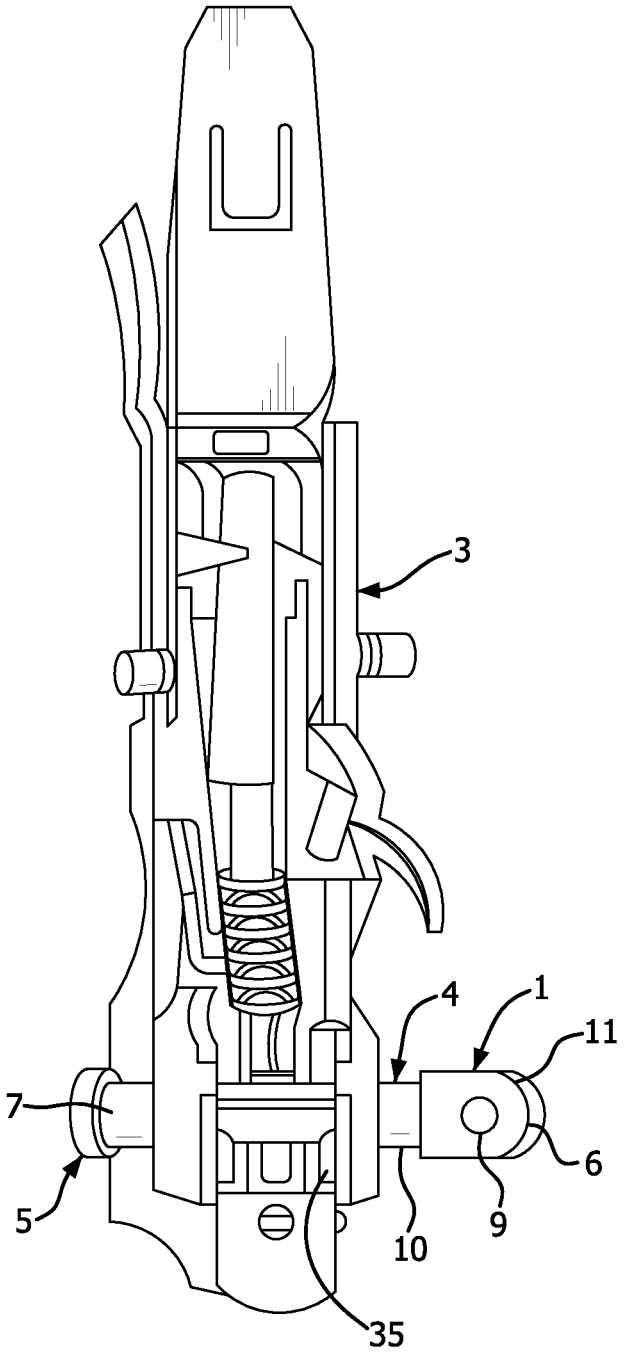
FIG. 5 is a top plan view in partial cross-section of the attachment assembly connected to the shotgun trigger group without the receiver of FIG. 4.
Figure 6:
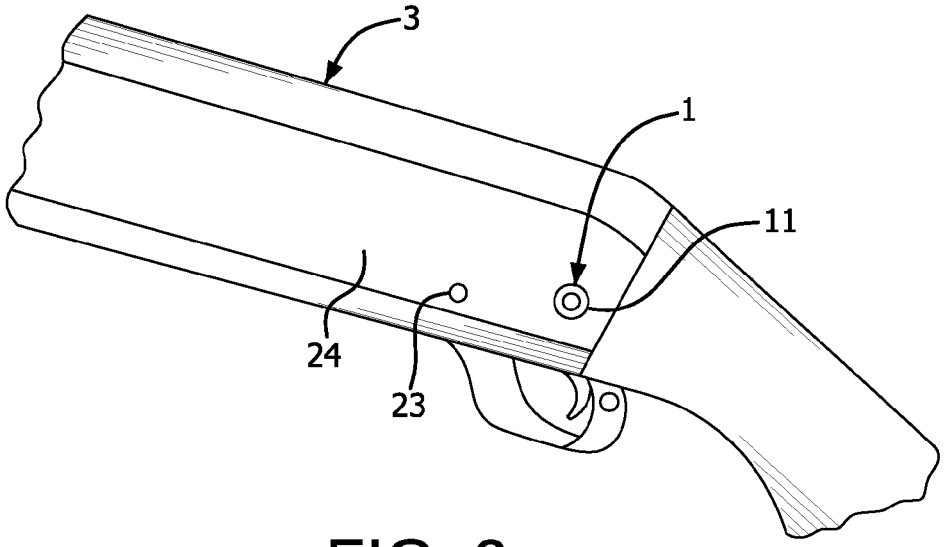
FIG. 6 is a side elevational view of the shotgun of FIG. 5.

As shown in FIGS. 1-9, an attachment assembly 1 secures a sling 2 to a firearm, such as a shotgun 3. The attachment assembly 1 includes a fastener 4 and a locking member 5. The fastener 4 has a first end 6 and a second end 7. The fastener 4 is receivable in a hole 8 in the shotgun 3 such that the first and second ends 6 and 7 are accessible on opposite sides of the shotgun, as shown in FIG. 5. A first opening 9 extends in the fastener 4 perpendicular to the fastener longitudinal axis and proximal the first end 6 to receive the swivel 27 of the sling 2. The locking member 5 is receivable by the second end 7 to prevent removal of the fastener 4 from the shotgun hole 8 when connected to the shotgun 3.

Figure 1:
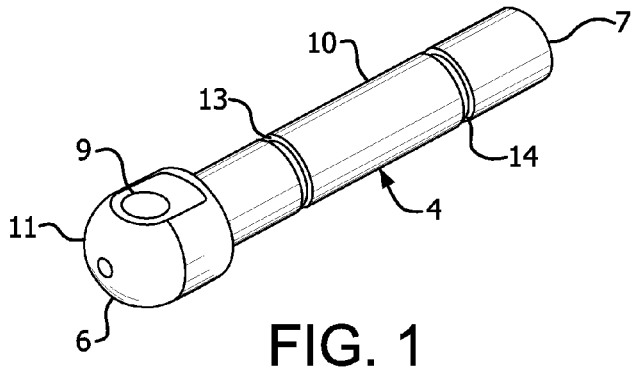
FIG. 1 is a perspective view of a mounting pin of an attachment assembly in accordance with a first exemplary embodiment of the present invention for securing a sling to a firearm.
Figure 2:
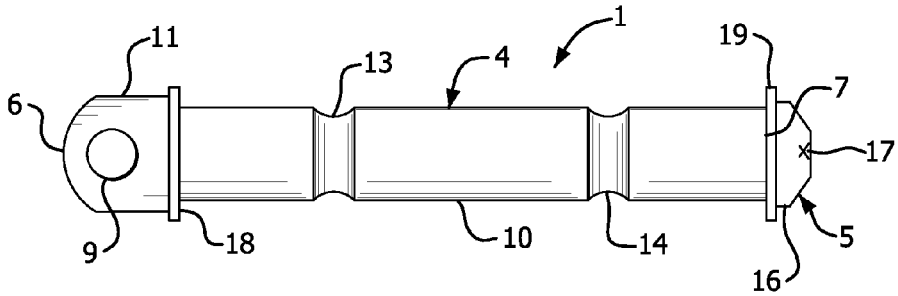
FIG. 2 is a front elevational view of the attachment assembly.

The fastener 4 has a substantially cylindrical body 10 with an enlarged head member 11 disposed at an end thereof, as shown in FIGS. 1-3. The enlarged head member 11 has a diameter larger than the diameter of the body 10. A first opening 9 is disposed in the enlarged head member 11. Preferably, the first opening 9 extends entirely through the enlarged head member 11. A second opening 12 extends axially inwardly in the body 10 from the second end 7 of the fastener 4, as shown in FIG. 3. The second opening 12 is preferably threaded and is preferably formed by drilling and tapping. First and second notches 13 and 14 extend circumferentially around the body 10 of the fastener 4. The first and second notches 13 and 14 are preferably disposed in the body 10 between the first and second ends 6 and 7. The fastener 4 is preferably unitarily formed as a single member and made of steel, such as 12L14 steel. Alternatively, the enlarged head member 11 can be separately formed and connected to the body 10 in any suitable manner, such as by a threaded connection. The fastener body 10 and enlarged head member 11 are preferably substantially solid members.

The locking member 5 includes a shaft 15 having a head member 16 disposed at an end thereof, as shown in FIG. 3. The shaft 15 is preferably threaded. A second opening 17 is disposed in the head member 16 to receive a tool 41, such as an alien key, to facilitate engaging the locking member 5 with the fastener 4. The locking member 5 is preferably unitarily formed as a single member and made of steel, such as 12L14 steel.

First and second washers 18 and 19 are disposed on the body 10 of the fastener 4 to prevent damage to the shotgun 3 from the enlarged head member 11 of the fastener 4 and the head member 16 of the locking member 5. The first and second washers 18 and 19 are preferably substantially circular having openings 20 and 21 therein to receive the fastener body 10. Preferably, the first and second washers 18 and 19 have an outer diameter corresponding to the outer diameter of the enlarged head member 11 and the head member 16, respectively. The first and second washers 18 and 19 are preferably made of nylon, or other suitable scratch resistant material.

To connect the attachment assembly 1 to a firearm, such as Remington or Winchester style shotguns, the first washer 18 is disposed on the body 10 of the fastener 4, as shown in FIG. 4. The first washer 18 is disposed adjacent a substantially planar surface 22 of the enlarged head member 11. The second end 7 of the fastener 4 is positioned on the shotgun's rear trigger group pin (not shown), which is located rearward of the front trigger group pin 23. A tool (not shown) is used to tap the enlarged head member 11 of the fastener 4, thereby driving the rear trigger group pin out of the shotgun 3. The rear trigger group pin can then be manually removed to provide a pin hole 8 in which the fastener 4 can be inserted. By using the rear trigger group pin, the muzzle of the shotgun 3 is raised higher from the ground, thereby facilitating carrying the shotgun and avoiding unwanted debris from entering the barrel. Alternatively, the forward trigger group pin 23 can be removed to provide a pin hole for insertion of the fastener 4. A substantially similar procedure can be used to remove a pin of a shotgun having only a single pin to secure the trigger group in place.

Figure 7:
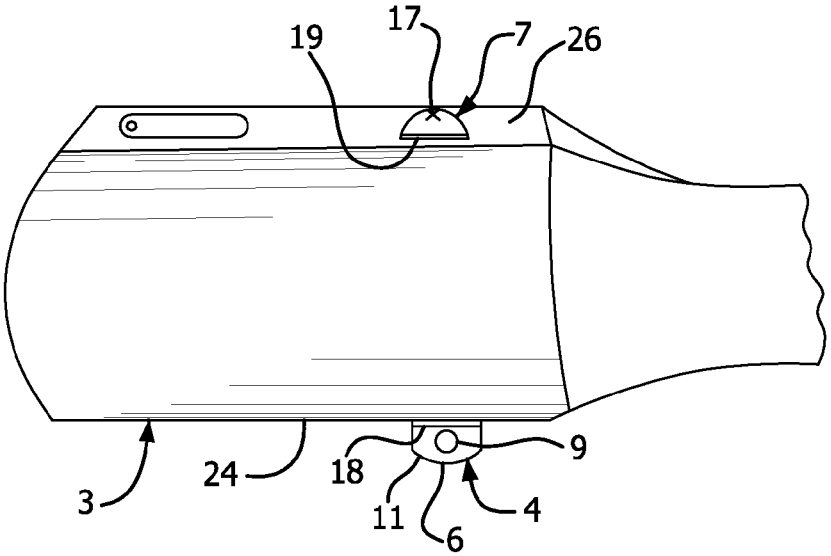
FIG. 7 is a top plan view of the shotgun of FIG. 5.

The second end 7 of the fastener 4 is inserted in the pin hole 8 until the first washer 18 engages a first sidewall 24 of the shotgun, as shown in FIG. 7. A beveled surface 25 at the second end 7 of the fastener 4 facilitates inserting the fastener in the pin hole 8. The outer diameters of the enlarged head portion 11 and the first washer 18 are larger than the diameter of the pin hole 8, thereby limiting an insertion depth of the fastener 4 and the first washer 18 in the pin hole 8. Accordingly, movement of the fastener 4 in a first direction is limited. The first notch 13 engages a spring member 35 of the trigger group assembly, as shown in FIG. 5, thereby further facilitating retention of the fastener 4 of the attachment assembly 1 in the shotgun 3. Alternatively, when inserting the fastener 4 from the left side as shown in FIG. 5, the second notch 14 of the fastener 4 engages the spring member 35. Accordingly, the fastener 4 is installable from either side of the firearm to accommodate left and right-handed shooters. The first washer 18 substantially prevents the enlarged head member 11 of the fastener 4 from scratching, marring or otherwise damaging the finish of the first side wall 24 of the shotgun 3.

The second end 7 of the fastener 4 passes entirely through the shotgun and is accessible on the second sidewall 25. The second washer 19 is disposed on the body 10 of the fastener 4 in a position abutting the second sidewall 25 of the shotgun 3.

An adhesive is disposed on the internal threads of the second opening 12 prior to inserting the locking member 5 therein. The locking member 5 is then inserted in the second opening 12 in the fastener 4, as shown in FIG. 7. The second washer 19 substantially prevents the locking member 5 from scratching, marring or otherwise damaging the finish of the second side wall 25 of the shotgun. The locking member 5 is threaded into the second opening 12 until snug by rotatably engaging the tool 41 with the locking member opening 17. The adhesive is allowed to set, thereby further facilitating securing the attachment assembly 1 to the shotgun 3 and preventing loosening of the threaded connection between the fastener 4 and the locking member 5.

The outer diameters of the enlarged head 16 of the locking member 5 and the second washer 19 are larger than the diameter of the pin hole 8, thereby preventing the fastener 4, the locking member 5 and the second washer 19 from being withdrawn from the pin hole 8 in a second direction. The second direction is substantially opposite to the first direction.

Figure 8:
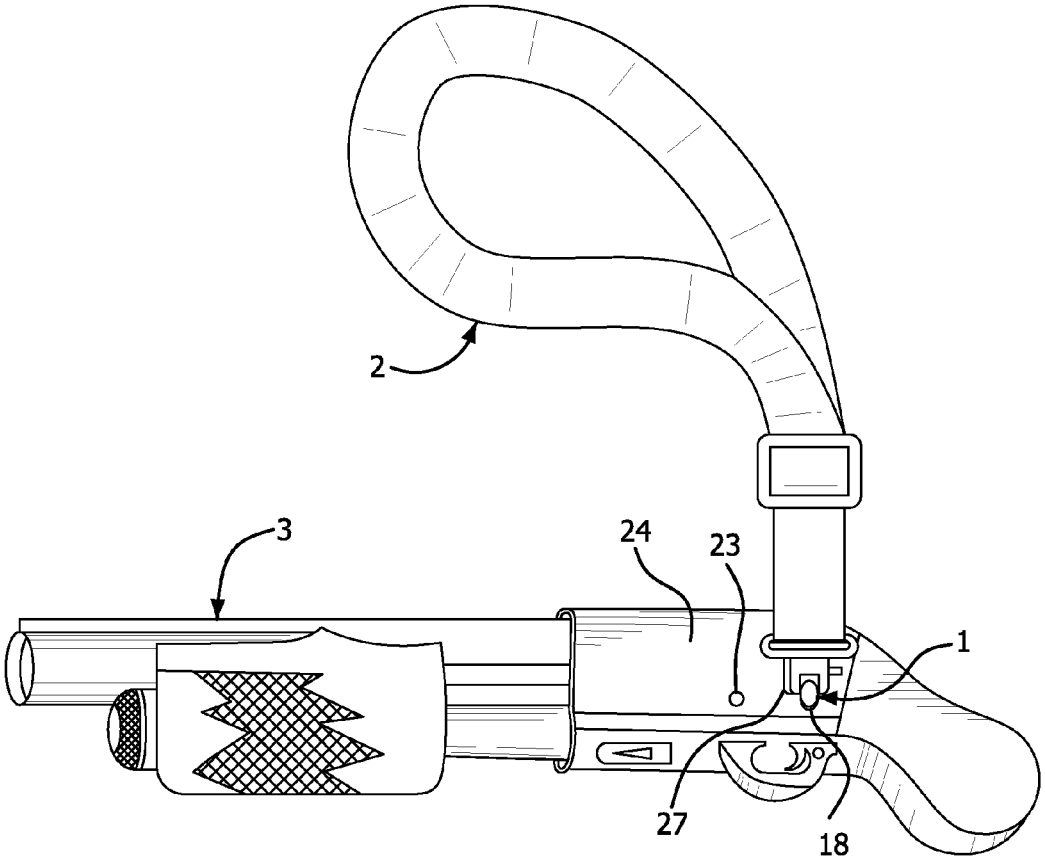
FIG. 8 is a perspective view of a single point sling attached to the shotgun with the attachment assembly of FIG. 2.

A swivel 27 of the sling 2 is passed through the opening 9 in the enlarged head member 11 of the fastener 4 of the attachment assembly 1, as shown in FIG. 8. A clevis pin or any other suitable member can be connected to the swivel 27 to prevent accidental removal of the swivel 27 from the opening 9 in the enlarged head member 11. The fastener 4 is a substantially linear member, thereby increasing its strength such that the attachment assembly 1 substantially resists breaking during use. The enlarged head member 11 and the locking member 5 of the attachment assembly 1 being connected to the firearm 3 at opposite sides thereof substantially prevents wobble or other movement between the attachment assembly and the firearm. By substantially preventing such movement, warping of the pin hole 8, which can lead to a loose fitting between the attachment assembly and the firearm, is substantially eliminated.

Figure 9:
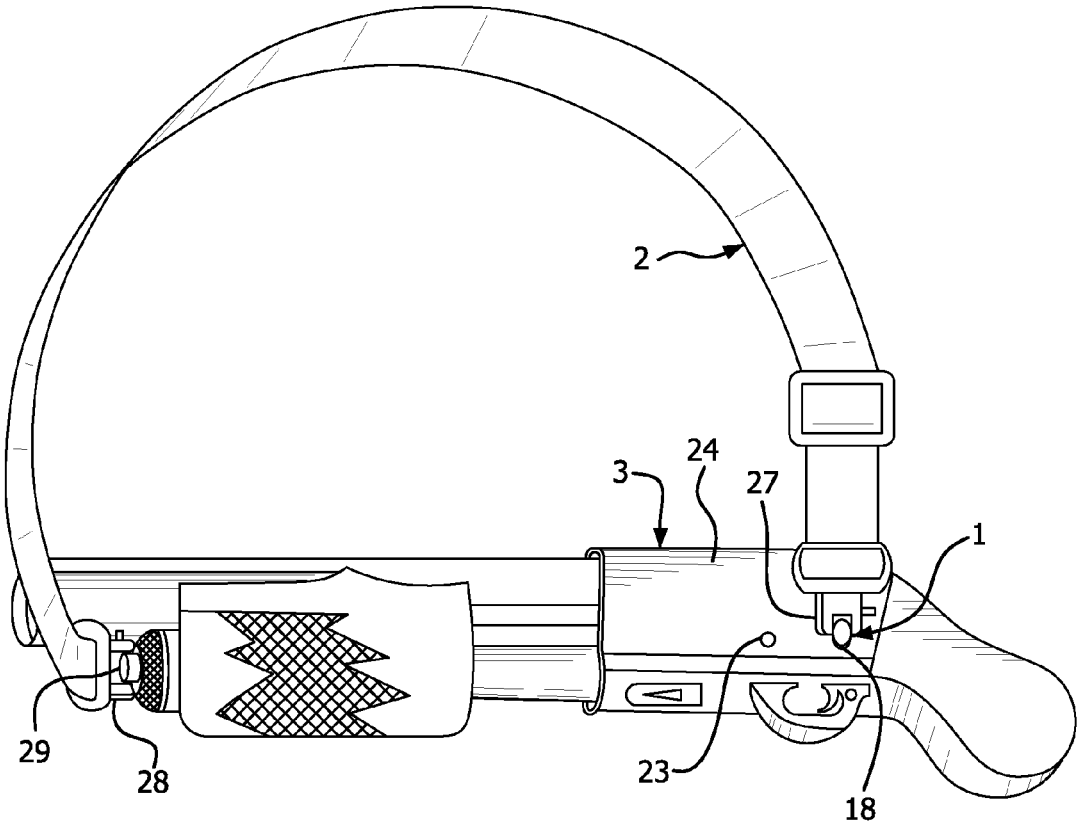
FIG. 9 is a perspective view of a two-point sling attached to the shotgun with the attachment assembly of FIG. 2.

Accordingly, the attachment assembly 1 can be quickly and easily connected to the shotgun 3 without requiring gunsmithing. As shown in FIG. 8, a single-point connection is used to connect the sling 2 to the shotgun 3, as is commonly used in the military. As shown in FIG. 9, a second swivel 28 is connected to an existing, conventional fastener assembly 29 connected to the shotgun 3, thereby forming a two-point connection for the sling 2.

Second Exemplary Embodiment

Figure 10:
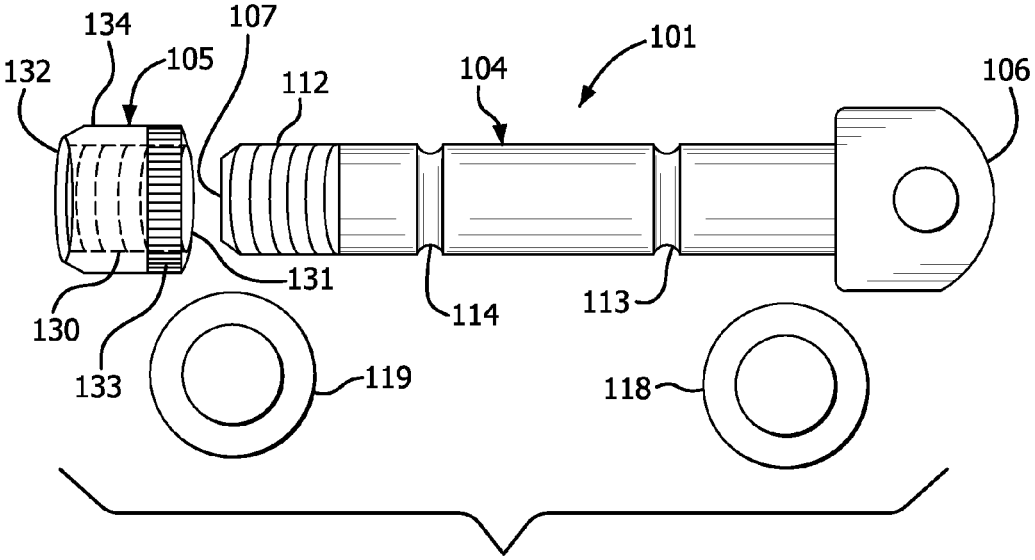
FIG. 10 is an exploded front elevational view of an attachment assembly in accordance with a second exemplary embodiment of the present invention for securing a sling to a shotgun.
Figure 11:
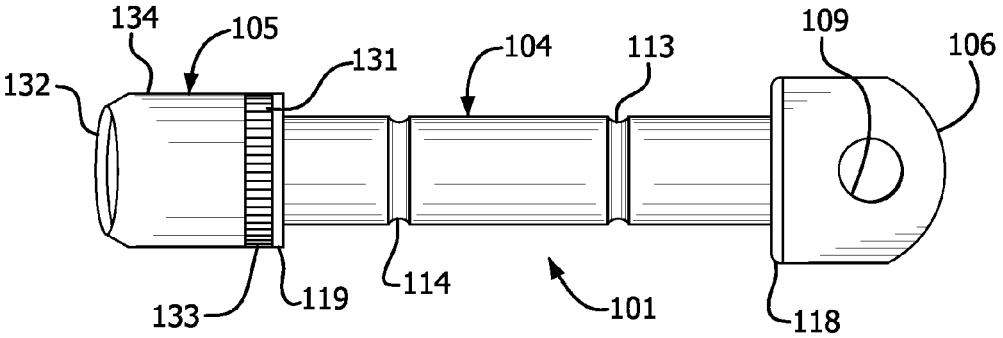
FIG. 11 is a front elevational view of the attachment assembly of FIG. 10.

A second exemplary embodiment of the present invention is shown in FIGS. 10 and 11 for securing a sling to a shotgun. The attachment assembly 101 of the second exemplary embodiment is substantially similar to the attachment assembly 1 of the first exemplary embodiment with the exception of the differences noted below. Similar reference numerals are used to indicate similar features, except in the 100 series, e.g., "1xx."

As shown in FIG. 10, the attachment assembly 101 includes a fastener 104 and a locking member 105. A portion 112 of a cylindrical body 110 of the fastener 104 extending rearwardly from a second end 107 of the fastener 104 is externally threaded. First and second notches 113 and 114 extend circumferentially around the body 110 of the fastener 104. The first and second notches 113 and 114 are preferably disposed in the body 110 between first and second ends 106 and 107.

The locking member 105 is a substantially cap-shaped member, as shown in FIG. 10. An opening 130 extends inwardly from a first end 131 to a second end 132 of the locking member 105. The locking member opening 130 is preferably threaded. A gripping surface 133 extends circumferentially around an outer surface 134 of the locking member 105. The locking member 5 is preferably unitarily formed as a single member and made of steel, such as 12L14 steel.

The attachment assembly 101 of the second exemplary embodiment is assembled in a substantially similar manner as the attachment assembly 1 of the first exemplary embodiment. The locking member 105 is threaded onto the threaded portion 112 of the fastener 104, as shown in FIG. 11. A swivel (27 of FIGS. 8 and 9) can be connected to the first opening 109 of the fastener 104 as described above. The attachment assembly 101 of the second exemplary embodiment facilitates connecting a sling to a firearm, such as a Mossberg and Benelli style shotguns.

Third Exemplary Embodiment

Figure 12:
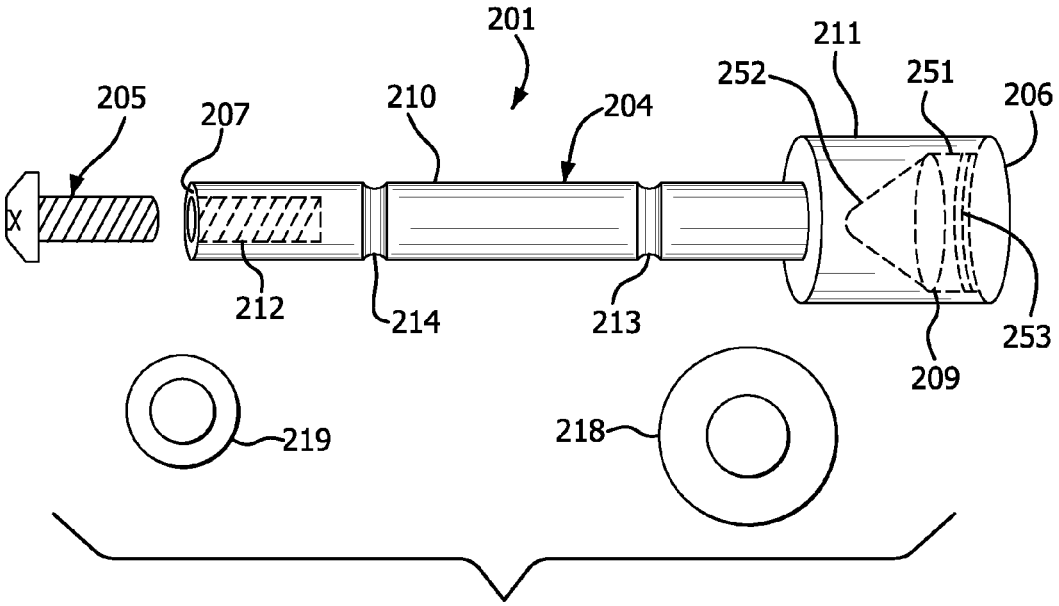
FIG. 12 is an exploded front elevational view of an attachment assembly in accordance with a third exemplary embodiment of the present invention for securing a push-button sling swivel to a shotgun.
Figure 13:
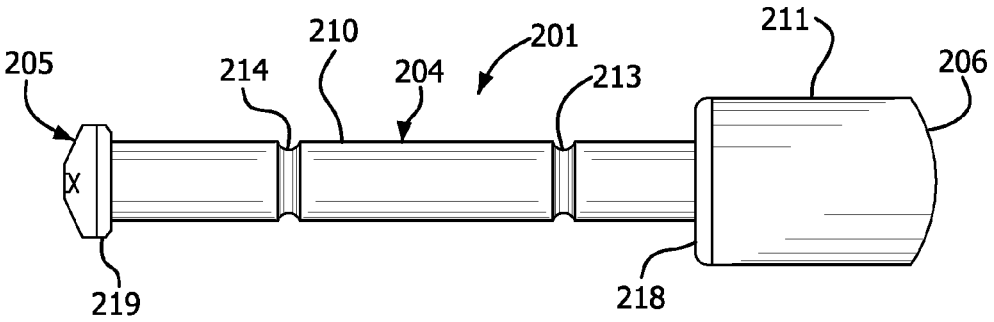
FIG. 13 is a front elevational view of the attachment assembly of FIG. 12.

A third exemplary embodiment of the present invention is shown in FIGS. 12 and 13 for securing a sling to a shotgun. The attachment assembly 201 of the third exemplary embodiment is substantially similar to the attachment assembly 1 of the first exemplary embodiment with the exception of the differences noted below. Similar reference numerals are used to indicate similar features, except in the 200 series, e.g., "2xx."

As shown in FIG. 12, the attachment assembly 201 includes a fastener 204 and a locking member 205. The fastener 204 has a first end 206 and a second end 207. A second opening 212 extends axially inwardly in a body 210 of the fastener 204 from the second end 7 thereof. The second opening 212 is preferably threaded and is preferably formed by drilling and tapping.

An enlarged head member 211 is disposed at the first end 206 of the fastener 204, as shown in FIGS. 12 and 13. The enlarged head member 211 has a diameter larger than the diameter of the body 210. A first opening 209 is disposed in the enlarged head member 211. Preferably, the first opening 209 extends partially into the enlarged head member 211, as shown in FIG. 12, and does not pass entirely through the enlarged head member. Preferably, the first opening 209 extends axially inwardly from the first end 206 of the fastener 204. The first opening 209 has a first substantially cylindrical portion 251, as shown in FIG. 12. A second portion 252 of the first opening 209 tapers inwardly. A groove 253 is formed in a surface of the first portion 251 of the opening 209 to facilitate receiving a pushbutton or quick connect swivel.

First and second notches 213 and 214 extend circumferentially around the body 210 of the fastener 204. The first and second notches 213 and 214 are preferably disposed in the body 10 between the first and second ends 206 and 207. The fastener 204 is preferably unitarily formed as a single member and made of steel, such as 12L14 steel. Alternatively, the enlarged head member 211 can be separately formed and connected to the body 210 in any suitable manner, such as by a threaded connection. The fastener body 210 and enlarged head member 211 are preferably substantially solid members The locking member 205 is substantially similar to the locking member 5 of the first exemplary embodiment. The locking member 205 is connected to the fastener 204 in a substantially similar manner as connecting the locking member 5 to the fastener 4 of the first exemplary embodiment. The outer diameter of a first washer 218 is preferably larger than an outer diameter of the second washer 219, as shown in FIG. 11.

Figure 21:
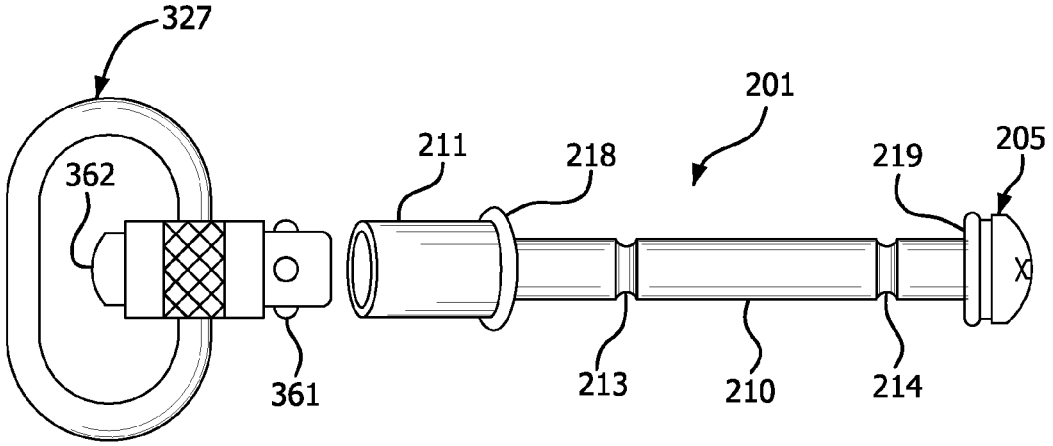
FIG. 21 is a front elevational view of the attachment assembly of FIG. 11 and a conventional pushbutton swivel.

The attachment assembly 201 of the third exemplary embodiment is assembled in a substantially similar manner as the attachment assembly 1 of the first exemplary embodiment. The first opening 209 in the enlarged head member 211 is adapted to receive a quick-connect swivel, as shown in FIG. 21 and described more fully below.

Fourth Exemplary Embodiment

A fourth exemplary embodiment of the present invention is shown in FIGS. 14-20 for securing a sling 302 to a shotgun 303. Similar reference numerals are used to indicate features similar to the previous described exemplary embodiments, particularly the second embodiment, except in the 300 series, e.g., "3xx."

Figure 14:
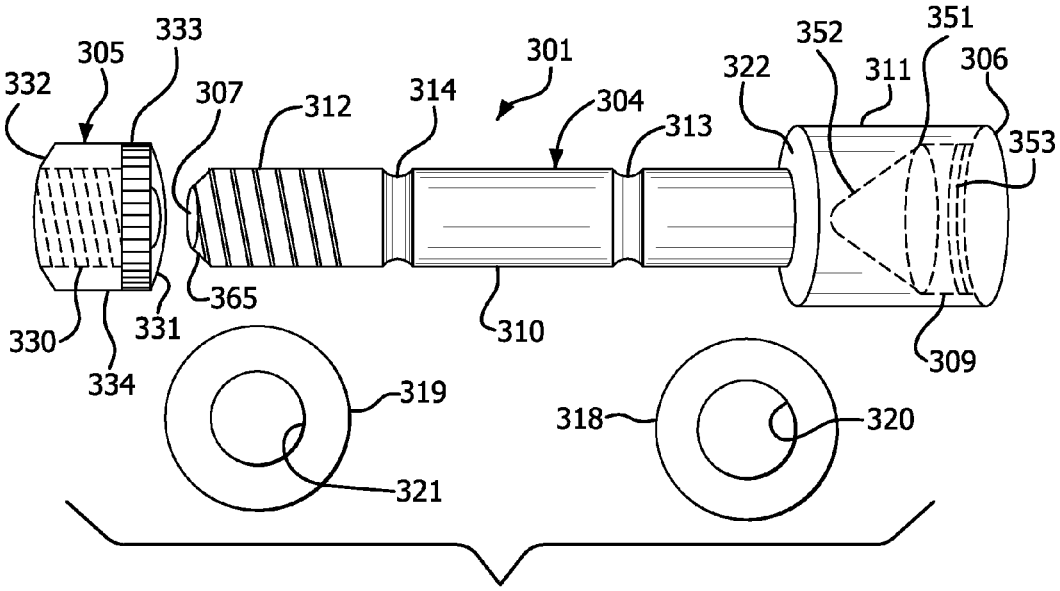
FIG. 14 is an exploded front elevational view of an attachment assembly in accordance with a fourth exemplary embodiment of the present invention for securing a push-button sling swivel to a shotgun.
Figure 15:
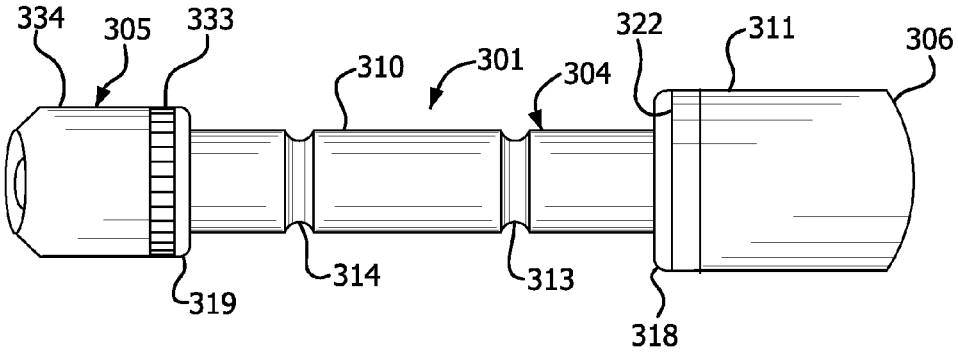
FIG. 15 is a front elevational view of the attachment assembly of FIG. 14.

The attachment assembly 301 includes a fastener 304 and a locking member 305, as shown in FIGS. 14 and 15. The fastener 304 is substantially similar to the fastener 204 of the third exemplary embodiment.

Figure 16:
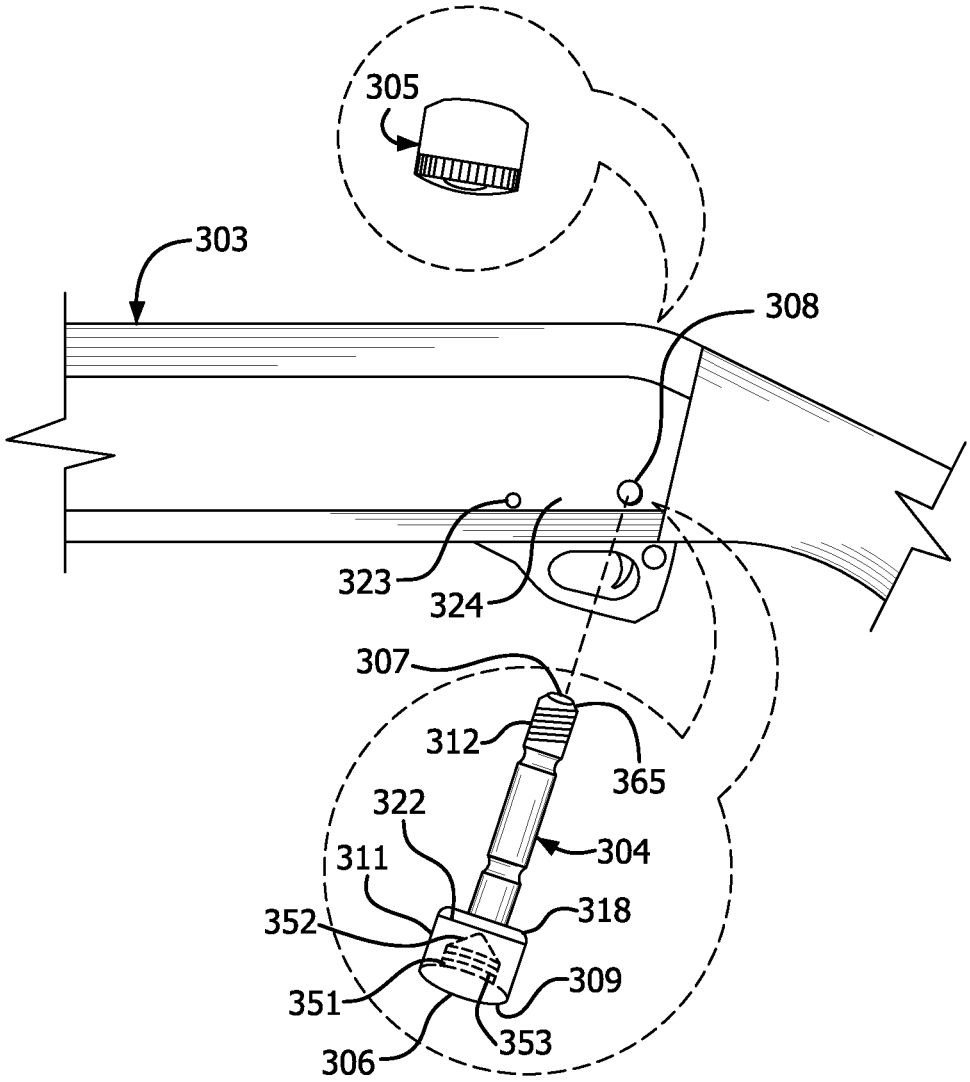
FIG. 16 is an exploded side elevational view of a shotgun with a trigger assembly retaining pin removed and prior to the attachment assembly of FIG. 15 being connected thereto.
Figure 17:
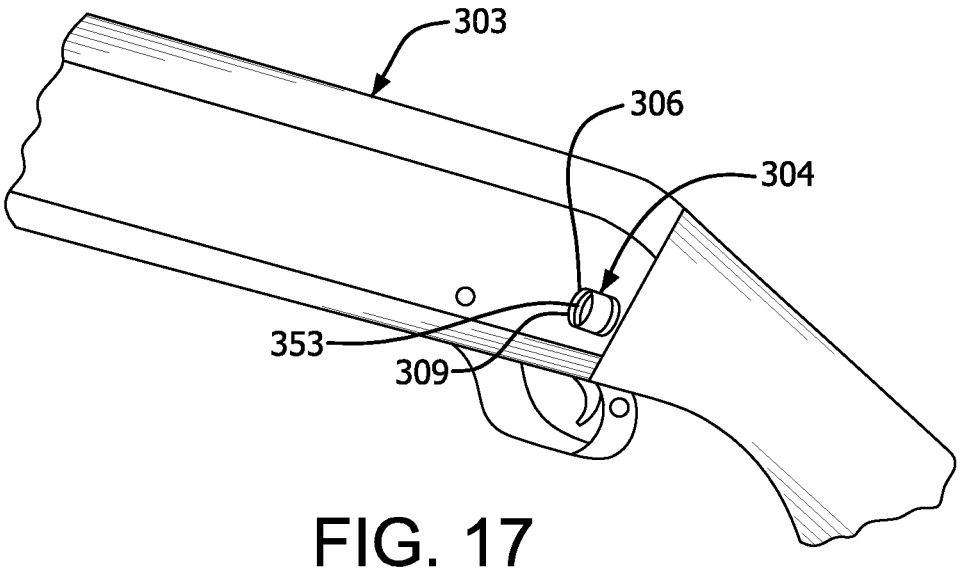
FIG. 17 is a side elevational view of the shotgun of FIG. 16 with the attachment assembly connected thereto.
Figure 18:
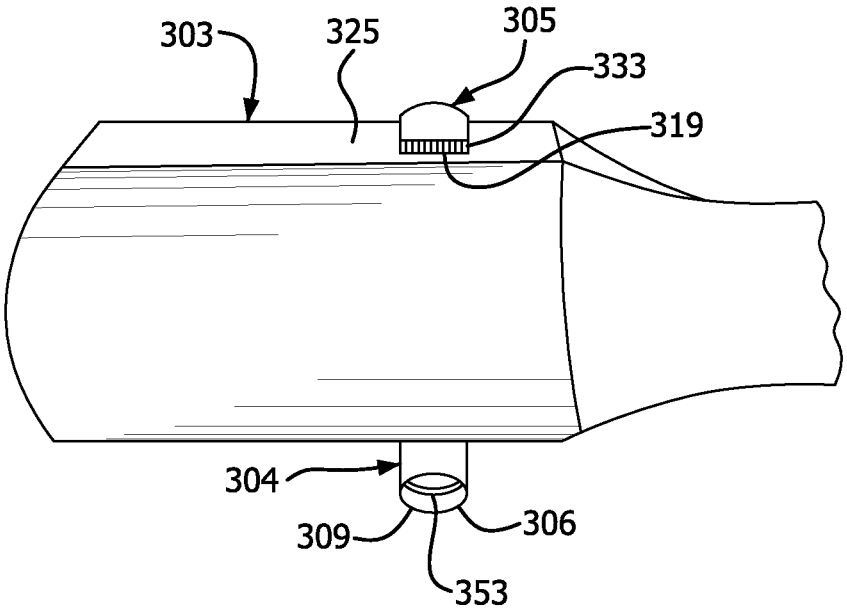
FIG. 18 is a top plan view of the shotgun of FIG. 17.
Figure 19:
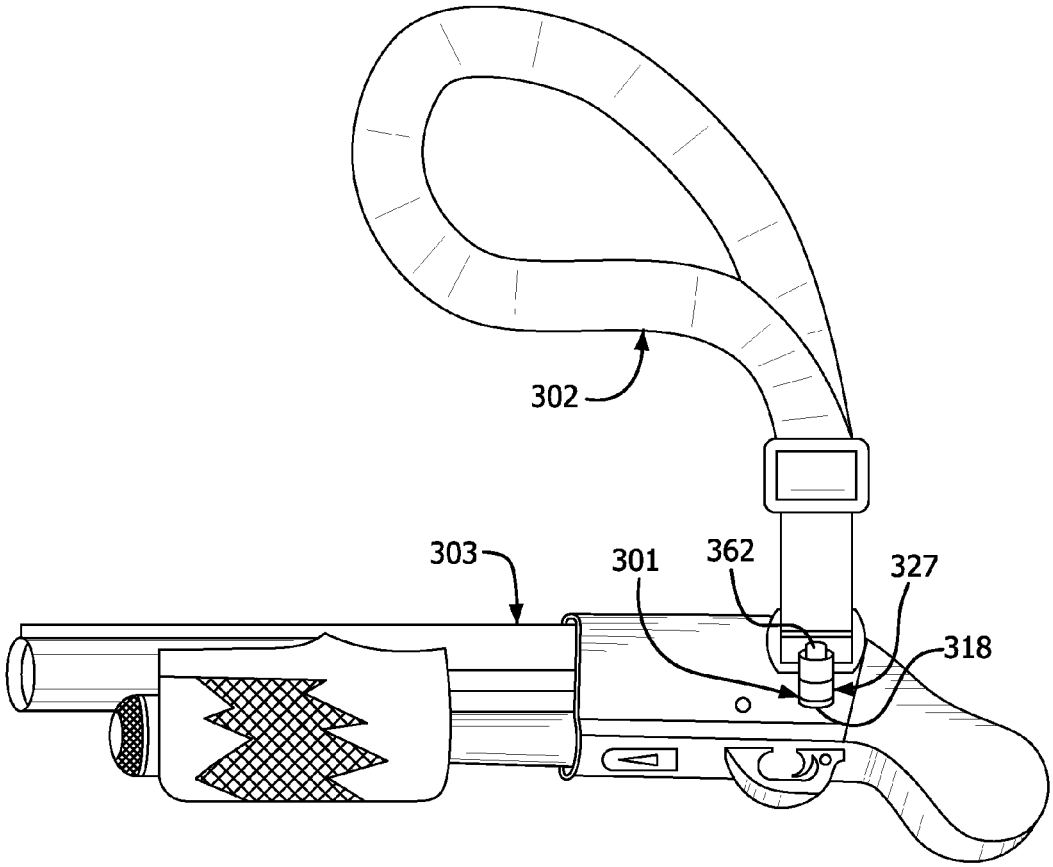
FIG. 19 is a perspective view of a single point push-button sling attached to the shotgun with the attachment assembly of FIG. 15.
Figure 20:
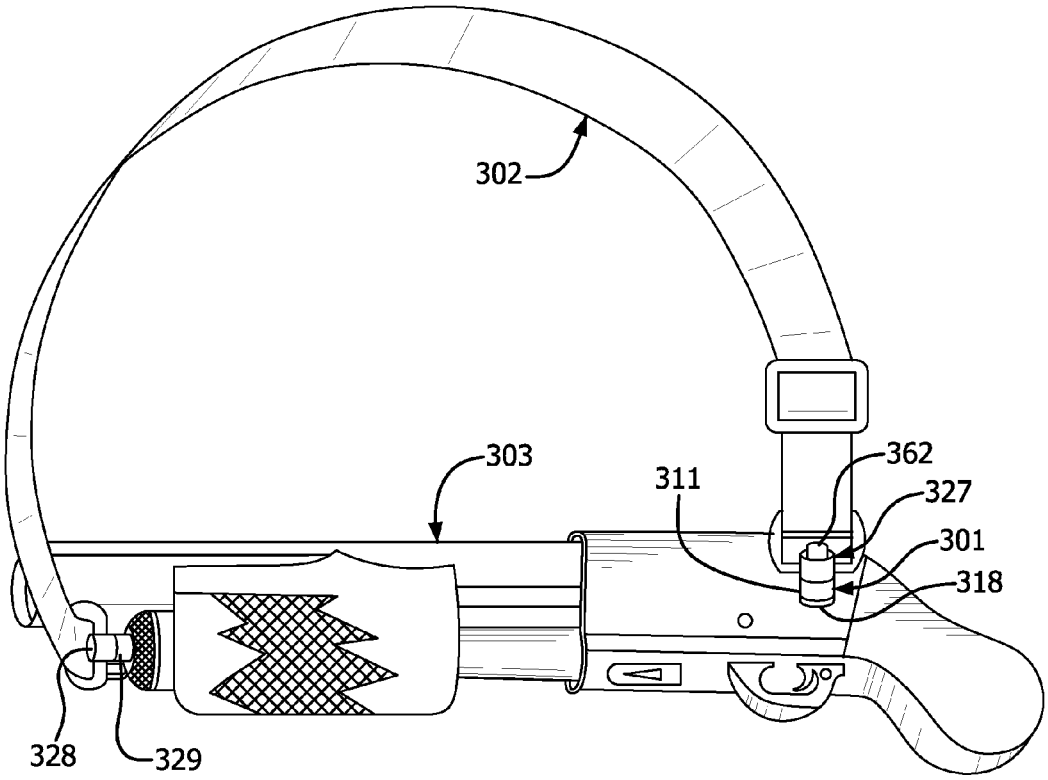
FIG. 20 is a perspective view of a two-point push-button sling attached to the shotgun with the attachment assembly of FIG. 15.

The fastener 304 has a first end 306 and a second end 307. The fastener 304 is receivable by a hole 308 in the shotgun 303 such that the first and second ends 6 and 7 are accessible on opposite sides of the shotgun, as shown in FIGS. 16-18. A first opening 309 in the fastener 304 proximal the first end 306 receives the sling 302, as shown in FIGS. 19 and 20. The locking member 305 is receivable by the second end 307 to prevent removal of the fastener 304 from the shotgun hole 308 when connected to the shotgun 303.

The fastener 304 has a substantially cylindrical body 310 with an enlarged head member 311 disposed at an end thereof, as shown in FIGS. 14 and 15. The enlarged head member 311 has a diameter larger than the diameter of the body 310. A first opening 309 is disposed in the enlarged head member 311. Preferably, the first opening 309 extends axially inwardly from the first end 306 of the fastener 304. As shown in FIG. 14, the first opening 309 does not extend entirely through the enlarged head member 311. The first opening 309 has a first substantially cylindrical portion 351, as shown in FIG. 14. A second portion 352 of the first opening 309 tapers inwardly. Alternatively, the first opening 309 of the enlarged head member 311 has only a substantially cylindrical portion. A groove 353 is formed in a surface of the first portion 351 of the opening 309 to facilitate receiving a pushbutton or quick connect swivel.

A portion 312 of the cylindrical body 110 of the fastener 304 extending rearwardly from the second end 307 of the fastener 304 is externally threaded, as shown in FIG. 14. First and second notches 313 and 314 extend circumferentially around the body 310 of the fastener 304. The first and second notches 313 and 314 are preferably disposed in the body 310 between the first and second ends 306 and 307. The fastener 304 is preferably unitarily formed as a single member and made of steel, such as 12L14 steel. Alternatively, the enlarged head member 311 can be separately formed and connected to the body 310 in any suitable manner, such as by a threaded connection. The fastener body 310 and enlarged head member 311 are preferably substantially solid members The locking member 305 is a substantially cap-shaped member, as shown in FIG. 14, and is substantially similar to the locking member 105 of the second exemplary embodiment. An opening 330 extends inwardly from a first end 331 to a second end 332 of the locking member 305. The locking member opening 330 is preferably threaded. A gripping surface 333 extends circumferentially around an outer surface 334 of the locking member 305. The locking member 305 is preferably unitarily formed as a single member and made of steel, such as 12L14 steel.

First and second washers 318 and 319 are disposed on the body 310 of the fastener 304 to prevent damage to the shotgun 303 from the enlarged head member 311 of the fastener 304 and the first end 331 of the locking member 305. The first and second washers 318 and 319 are preferably substantially circular having openings 320 and 321 therein to receive the fastener body 310. Preferably, the first and second washers 318 and 319 have an outer diameter corresponding to the outer diameter of the enlarged head member 311 and the locking member 305, respectively. As shown in FIG. 15, the outer diameter of the first washer 318 is preferably larger than the outer diameter of the second washer 319. The first and second washers 318 and 319 are preferably made of nylon, or other suitable scratch resistant material.

To connect the attachment assembly 301 to a firearm, such as Mossberg or Benelli style shotguns, the first washer 318 is disposed on the body 310 of the fastener 304, as shown in FIG. 16. The first washer 318 is disposed adjacent a substantially planar surface 322 of the enlarged head member 311. The second end 307 of the fastener 304 is positioned on the shotgun's rear trigger group pin (not shown), which is located rearward of the front trigger group pin 323. A tool (not shown) is used to tap the enlarged head member 311 of the fastener 304, thereby driving the rear trigger group pin out of the shotgun 303. The rear trigger group pin can then be manually removed to provide a pin hole 308 in which the fastener 304 can be inserted. By using the rear trigger group pin, the muzzle of the shotgun 3 is raised higher from the ground, thereby facilitating carrying the shotgun and avoiding unwanted debris from entering the barrel.

The second end 307 of the fastener 304 is inserted in the pin hole 308 until The first washer 318 engages a first sidewall 324 of the shotgun, as shown in FIG. 17. A beveled surface 365 at the second end 307 of the fastener 304 facilitates inserting the fastener in the pin hole 308. The outer diameters of the enlarged head portion 311 and the first washer 318 are larger than the diameter of the pin hole 308, thereby limiting an insertion depth of the fastener 304 and the first washer 318 in the pin hole 308. Accordingly, movement of the fastener 304 in a first direction is limited. The first and second notches 313 and 314 engage first and second spring members 35 and 36 (FIG. 5) of the trigger group assembly, thereby further facilitating retention of the fastener 304 of the attachment assembly 301 in the shotgun 303. The first washer 318 substantially prevents the enlarged head member 311 of the fastener 304 from scratching, marring or otherwise damaging the finish of the first side wall 324 of the shotgun 303.

The second end 307 of the fastener 304 passes entirely through the shotgun 303 and is accessible on the second sidewall 325. The second washer 319 is disposed on the body 310 of the fastener 304 in a position abutting the second sidewall 325 of the shotgun 303.

An adhesive is disposed on the external threads of the threaded portion 312 of the fastener 304 prior to connecting the locking member 305 thereto. The locking member 305 is then disposed on the threaded portion 312 of the fastener 304, as shown in FIG. 18, such that the opening 330 of the locking member 305 threadably engages the threaded portion 312 of the fastener 304. The second washer 319 substantially prevents the locking member 305 from scratching, marring or otherwise damaging the finish of the second side wall 325 of the shotgun 303. The locking member 305 is threaded onto the threaded portion 312 until snug. The adhesive is allowed to set, thereby further facilitating securing the attachment assembly 301 to the shotgun 303 and preventing loosening of the threaded connection between the fastener 304 and the locking member 305.

The outer diameters of the locking member 305 and the second washer 319 are larger than the diameter of the pin hole 308, thereby preventing the fastener 304, the locking member 305 and the second washer 319 from being withdrawn from the pin hole 308 in a second direction. The second direction is substantially opposite to the first direction.

A conventional pushbutton swivel 327 of the sling 302 is inserted in the opening 309 in the enlarged head member 311 of the fastener 304 of the attachment assembly 301, as shown in FIG. 19. The swivel 327 is a quick connect type connection that quickly and easily connects to the opening 309 in the enlarged head member 311. For example, the swivel 327 can use a plurality of spring-loaded ball bearings that are received by the groove 353 in the first portion 351 of the opening 309 to securely retain the sling 302 to the attachment assembly 301. The fastener 304 is a substantially linear member, thereby increasing its strength such that the attachment assembly 301 substantially resists breaking during use. The enlarged head member 311 and the locking member 305 of the attachment assembly 301 being connected to the firearm 303 at opposite sides thereof substantially prevents wobble or other movement between the attachment assembly and the firearm. By substantially preventing such movement, warping of the pin hole 308, which can lead to a loose fitting between the attachment assembly and the firearm, is substantially eliminated.

Accordingly, the attachment assembly 301 can be quickly and easily connected to the shotgun 303 without requiring gunsmithing. As shown in FIG. 19, a single-point connection is used to connect the sling 302 to the shotgun 303, as is commonly used in the military. As shown in FIG. 20, a second swivel 328 is connected to an existing fastener assembly 329 connected to the shotgun 303, thereby forming a two-point connection for the sling 302.

The conventional pushbutton swivel 327 is shown in FIG. 21 prior to being connected to the fastener 204 of the attachment assembly 201 of the third exemplary embodiment. The swivel 327 has a plurality of ball bearings 361 that are received by the groove 253 in the enlarged head member 211, thereby securing the swivel 327 to the attachment assembly 201. A pushbutton 362 is pushed axially inwardly to release the ball bearings 361 from the groove 253, thereby allowing the swivel to be quickly detached from the fastener assembly 201.

The foregoing embodiments and advantages are merely exemplary and are not to be construed as limiting the scope of the present invention. The description of an exemplary embodiment of the present invention is intended to be illustrative, and not to limit the scope of the present invention. Various modifications, alternatives and variations will be apparent to those of ordinary skill in the art, and are intended to fall within the scope of the invention as defined in the appended claims and their equivalents.

What is claimed is:

1. An attachment assembly for securing a sling to a firearm, comprising:

a fastener having first and second ends, said fastener being receivable by a pin hole in a trigger group of the firearm such that said first and second ends are accessible on opposite sides of the trigger group, said first end having an enlarged head member;

a first opening in said fastener proximal said first end to receive the sling; and a locking member receivable by said second end to prevent removal of said fastener from the pin hole when connected to the trigger group.

2. The attachment assembly according to claim 1, wherein said first opening extends entirely through said fastener.

3. The attachment assembly according to claim 1, wherein said first opening extends axially inwardly from said first end of said fastener.

4. The attachment assembly according to claim 1, wherein a second opening extends axially inwardly from said second end of said fastener.

5. The attachment assembly according to claim 4, wherein said second opening is threaded to threadably engage said locking member.

6. The attachment assembly according to claim 1, wherein an externally threaded portion extends axially from said second end of said fastener to threadably engage said locking member.

7. The attachment assembly according to claim 5, wherein said locking member is externally threaded to threadably engage said second opening of said fastener.

8. The attachment assembly according to claim 6, wherein said locking member is internally threaded to threadably engage said externally threaded portion of said fastener.

9. The attachment assembly according to claim 1, wherein said enlarged head member is disposed at said first end of said fastener to prevent said first fastener from being pushed through the firearm hole.

10. The attachment assembly according to claim 9, wherein first and second washers are disposed on said fastener, said first washer being disposed between said enlarged head member and the firearm and the second washer being disposed between the firearm and said locking member.

11. The attachment assembly according to claim 1, wherein said second end of said fastener has a beveled outer surface to facilitate inserting said fastener in the firearm pin hole.

12. The attachment assembly according to claim 1, wherein said locking member has a gripping surface to facilitate manually tightening said locking member.

13. The attachment assembly according to claim 1, wherein an opening in said locking member is engageable with a tool to facilitate tightening said locking member.

14. The attachment assembly according to claim 1, wherein first and second circumferential notches are disposed in an outer surface of said fastener to facilitate engaging said fastener with the firearm pin hole.

15. A kit for securing a sling to a firearm, comprising:

a fastener having first and second ends receivable by a pin hole in a trigger group for mounting the sling to the firearm, an opening proximal said first end of said fastener to receive said sling; and a locking member receivable by said second end of said fastener to prevent removal of said fastener from the pin hole when connected to the trigger group.

16. The kit for securing a sling to a firearm according to claim 15, further comprising first and second washers.

17. The kit for securing a sling to a firearm according to claim 15, further comprising an adhesive.

18. The kit for securing a sling to a firearm according to claim 15, further comprising a tool for tightening said locking member.

19. A method of securing a sling to a firearm, comprising the steps of inserting a mounting pin in a pin hole in a firearm trigger group, the mounting pin having an enlarged head member to prevent pushing the mounting pin through the pin hole in a first direction;

connecting a locking member to a second end of the mounting pin to prevent removal of the mounting pin from the pin hole in a second direction substantially opposite to the first direction; and connecting the sling to a second opening in the enlarged head member of the mounting pin.

20. The method of securing a sling to a firearm according to claim 19, further comprising disposing a first washer on the mounting pin prior to inserting the mounting pin in the first opening such that the first washer is positioned between the trigger group and the enlarged head member; and disposing a second washer on the mounting pin after inserting the mounting pin in the first opening such that the second washer is positioned between the trigger group and the locking member.

* * * * *